US005146536A

United States Patent [19]

Westover

[11] Patent Number: 5,146,536

[45] Date of Patent: Sep. 8, 1992

[54] HIGH TEMPERATURE ELECTRIC AIR HEATER WITH TRANVERSELY MOUNTED PTC RESISTORS

[76] Inventor: Brooke N. Westover, 1044 Fleming Dr., Pensacola, Fla. 32514

[21] Appl. No.: 662,955

[22] Filed: Mar. 1, 1991

Related U.S. Application Data

[63] Continuation-in-part of Ser. No. 268,188, Nov. 7, 1988, Pat. No. 5,004,893.

[51] Int. Cl.[5] ..... H05B 3/10; H05B 3/78

[52] U.S. Cl. ..... 392/488; 219/505; 219/553; 219/537; 219/541; 338/22 R; 338/317

[58] Field of Search ..... 392/360–365, 392/485, 488, 379, 486–487, 489–494, 379–385; 219/505, 553, 537, 541; 338/22 R, 320, 317

[56] References Cited

U.S. PATENT DOCUMENTS

| | | | |
|---|---|---|---|
| 1,313,258 | 8/1919 | Carmean et al. | 392/360 |
| 1,997,776 | 4/1935 | Hogel | 392/485 |
| 2,223,429 | 12/1940 | Smith et al. | 392/349 |
| 2,596,327 | 5/1952 | Cox et al. | 392/485 |
| 2,697,164 | 12/1954 | Knapp et al. | 392/376 |
| 2,707,745 | 5/1955 | Farr et al. | 392/376 |
| 2,909,752 | 10/1959 | Mazzucchelli et al. | 338/226 |
| 3,108,174 | 10/1963 | Hynes | 392/485 |
| 3,506,771 | 4/1970 | Cole, Jr. | 35/25 |
| 3,700,857 | 10/1972 | Brandes et al. | 219/543 |
| 3,900,819 | 8/1975 | Djorup | 338/320 |
| 4,162,395 | 7/1979 | Kobayashi et al. | 219/537 |
| 4,237,441 | 12/1980 | van Konynenburg et al. | 338/22 |
| 4,302,508 | 11/1981 | Hierholzer, Jr. et al. | 219/553 |
| 4,486,651 | 12/1984 | Atsumi et al. | 219/553 |
| 4,541,898 | 9/1985 | Mase et al. | 204/424 |
| 4,544,828 | 10/1985 | Shigenobu et al. | 219/216 |
| 4,555,358 | 11/1985 | Matsushita et al. | 252/516 |
| 4,590,489 | 5/1986 | Tsumura et al. | 338/317 |
| 4,613,455 | 9/1986 | Suzuki et al. | 252/516 |
| 4,633,064 | 2/1986 | Atsumi et al. | 219/270 |
| 4,634,837 | 1/1987 | Ito et al. | 219/270 |
| 4,706,736 | 11/1987 | Gyori | 219/400 |
| 4,855,570 | 8/1989 | Wang | 219/505 |
| 4,876,436 | 10/1989 | Ide et al. | 338/22 R |
| 5,004,893 | 4/1991 | Westover | 219/505 |

FOREIGN PATENT DOCUMENTS

| | | | |
|---|---|---|---|
| 220103 | 3/1985 | Fed. Rep. of Germany | 392/487 |
| 92352 | 1/1922 | Switzerland | 392/492 |
| 916586 | 1/1963 | United Kingdom | 392/379 |

*Primary Examiner*—Bruce A. Reynolds
*Assistant Examiner*—John A. Jeffery
*Attorney, Agent, or Firm*—H. Gibner Lehmann; K. Gibner Lehmann

[57] ABSTRACT

A high-speed, high temperature electrical heater construction, including an elongate air-tunnel, and a plurality of PTC resistance members insulatedly mounted in the walls of the air tunnel, and extending transversely thereof. The PTC resistance members have oppositely disposed terminal portions for connection to an electrical supply, for energization of the members.

12 Claims, 2 Drawing Sheets

HIGH TEMPERATURE ELECTRIC AIR HEATER WITH TRANVERSELY MOUNTED PTC RESISTORS

CROSS REFERENCES TO RELATED APPLICATIONS

The present continuation-in-part application claims priority under 35 USC 120, my co-pending application, U.S. Ser. No. 07/268,188 filed Nov. 7, 1988, now U.S. Pat. No. 5,004,893 dated Apr. 2, 1991.

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates generally to electrical resistance heaters, and more particularly to heaters of the type incorporating PTC ceramic material which renders the heaters self-regulating at various preselected elevated temperatures.

2. Description of the Related Art Including Information Disclosed Under 37 CFR §§1.97–1.99

Various types of resistance heaters are disclosed in U.S. Pat. Nos. 3,700,857; 4,486,651; 4,541,898; 4,544,828; 4,613,455; and 4,633,064.

U.S. Pat. No. '857 describes a heater consisting of a sintered mass of insulating refractory particles each of which has a thin film of electrically conductive material. U.S. Pat. No. '651 shows a ceramic heater having an element formed by sintering a mixture of molybdenum disilicide and silicon nitride.

U.S. Pat. No. '898 discloses a heating element composed of multiple finely divided particles of substance having a negative temperature coefficient of resistance, between which there are disposed areas of high resistance or areas of electrically non-conductive material. The resultant heater has different impedance characteristics according to the frequency of the A. C. wave that is applied to it.

U.S. Pat. No. '455 involves mixtures of different types of ceramics, namely silicon nitride as an insulating ceramic and a mixture of titanium carbide and titanium nitride as a conductive ceramic. The ceramics are mixed in powder form, and thereafter sintered. U.S. Pat. No. '064 illustrates a sintered heater element formed from an insulating ceramic powder such as silicon nitride, and a conductive ceramic powder such as $MoSi_2$, $WSi_2$, $TiB_2$ or TiC.

Finally U.S. Pat. No. '828 relates to a heater formed by crushing PTC ceramic material, and mixing it with an insulating organic binder, to form the desired PTC resistor.

As presently understood, the devices disclosed in the above identified patents can be difficult to produce, since the ultimate resistance/temperature characteristics are largely determined by the relative proportions of the conductive material and insulating material, as well as the degree of sintering and the sintering temperature. It is believed that a reasonably close control of this resistance/temperature characteristic has, up to the present, been difficult to predict and achieve, as was uniformity of performance between different units of the same run.

In addition, where high temperatures on the order of 3000° F. are being generated during operation of the heaters, problems occur with establishing satisfactory electrical contact to the elements. The use of metal electrodes can be prohibitive, since the melting temperature of metal contacts is well below the 3000° F. figure noted above. As a result, most heaters of the prior art devices are intended to operate at temperatures well below this point.

SUMMARY OF THE INVENTION

The above disadvantages and drawbacks of prior PTC ceramic heaters are largely obviated by the present invention, which has for one object the provision of a novel PTC heater which is both low in manufacturing cost, and is characterized by improved control of the temperature/resistance characteristic.

A related object of the invention is to provide an improved PTC heater as above set forth, which is especially well adapted for use at temperatures approaching 3000° F., while still maintaining reliability over extended periods of use.

Still another object of the invention is to provide an improved PTC heater of the kind indicated, which is characterized by a physical configuration which leads to the development of one area that constitutes a hot spot or hot area; the configuration has other, spaced apart areas which, by virtue of their mass, do not become as hot as the hot spot or area, thereby facilitating making of electrical connections to the heater.

Yet another object of the invention is to provide an improved PTC heater in accordance with the foregoing, wherein relatively massive terminal portions are provided and connected by a relatively smaller bridge portion, the latter, by virtue of its smaller mass, becoming heated more rapidly than the terminal portions, thereby enabling electrical contacts to be made to the terminal portions as a result of their relatively lower temperature.

A still further object of the invention is to provide an improved PTC heater as outlined above, wherein relatively massive terminal portions are connected by a relatively smaller bridge portion, with the latter essentially assuming complete control over the current flow through the terminal portions when the bridge portion heats sufficiently.

A further object of the invention is to provide a PTC heater as above characterized, wherein one ceramic component is first formed into a matrix, and thereafter the second ceramic component is forced into the matrix so as to permeate the same. One of the ceramic components is electrically insulating, whereas the other ceramic component has a PTC resistance characteristic.

A still further object of the invention is to provide a composite, non-homogeneous PTC heater as above described, wherein there are formed, interspersed in a ceramic matrix, nodes and threads of a second ceramic. Either the first ceramic can be electrically insulating, with the other ceramic having a PTC characteristic, or vice-versa.

In accomplishing the above objects the invention provides a high-speed high temperature electrical heater construction, comprising in combination means defining an elongate air-tunnel, and one or more PTC resistance members insulatedly mounted in the air tunnel and extending transversely thereof. The PTC resistance members have oppositely disposed terminal portions for connection to an electrical supply, to effect energization of the same.

Other features and advantages will hereinafter appear.

Figure 1:
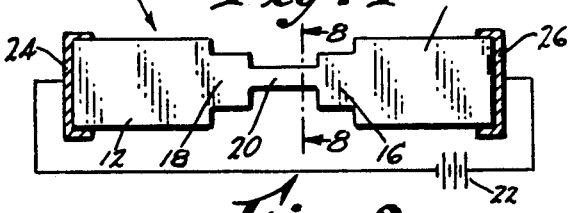
FIG. 1 is a top plan view of a strip heater of PTC material constructed in accordance with the principles of the present invention; electrical terminals are shown in section.
Figure 2:
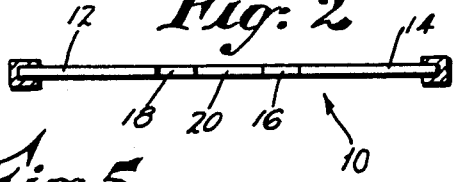
FIG. 2 is an edge elevation of the heater of FIG. 1.
Figure 8:
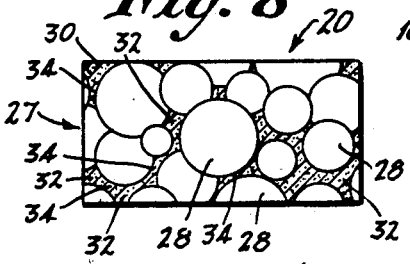
FIG. 8 is a section, greatly enlarged, taken on the line 8—8 of FIG. 1, showing a matrix of vitreous, electrically insulating material, and PTC material interspersed therein and taking the form of multiple nodes connected by multiple threads.

Referring first to FIGS. 1 2 and 8 and in accordance with the invention there is provided a novel and improved PTC (positive temperature coefficient of resistance) electric heater generally designated by the numeral 10. In the embodiment illustrated, the heater takes the form of a strip having end or terminal portions 12, 14, control portions 16, 18, and a single high-temperature bridge portion 20, the control portions 16, 18 being narrower than the terminal portions 12, 14, and the high-temperature bridge portion 20 being still narrower than the control portions 16, 18. When the terminal portions 12, 14 are connected to a source of voltage 22, current will flow through one terminal portion 12, one control portion 18, the bridge portion 20, the other control portion 16 and the other terminal portion 14, resulting in heating of all five portions. Since the relative masses of the terminal portions 12, 14 are greater than that of the bridge portion 20, the latter will heat more quickly and to a higher temperature, and ultimately limit the current to a predetermined, desired value. Such a value is below that which would heat the control or terminal portions to any significant degree, whereby these terminal portions 12, 14 remain sufficiently cool to enable metal contacts or terminals illustrated in section at 24 and 26, to be attached thereto.

As shown in FIG. 8, the heater 10 is constituted of a nonhomogeneous substance, namely either two different ceramics or a PTC ceramic and a vitreous substance (such as a glass formulation). The material is fabricated by compressing particles or balls 28 of the vitreous substance in a suitable press (not shown), using heat if necessary, and thereafter sintering the mass so as to form a matrix generally designated by the numeral 27 of the vitreous substance. One definition of the word matrix, given in Webster's Third New International Dictionary, 1963, is as follows: "3: a mass by which something is enclosed or in which something is embedded." As illustrated, there are interstices or passageways in the matrix 27. Following formation of the matrix, a PTC ceramic 30 is forced to permeate into the interstices of the matrix, and form nodes 32 therein, which nodes 32 are connected by thin threads 34. Electric current flow is from one node 32 to an adjacent node 32, through one or more of the connecting threads 34.

The PTC ceramic 30 can be introduced into the matrix 27 by a combination of heat and pressure, or heat alone. Alternately, a carrier solvent (not shown) containing finely divided particles of the PTC ceramic 30 can be introduced at the surface of the matrix 27, forced to flow into the passageways thereof and fill them, forming the nodes 32 and threads 34.

As presently understood, by adjusting the size of the passages in the initially formed matrix 27, the ultimate conductivity characteristics of the resistance heater can be established with considerable control, and the degree of control possible with the present invention is greater than that obtainable where mere mixing of PTC and insulating ceramic powders was employed to fabricate the resistance material, as in the prior art devices.

Heating of the threads 34 causes their resistance to increase; this occurs rapidly, and thus the current limiting which occurs similarly takes place very soon after the application of voltage to the terminal portions 12, 14 of the heater 10.

The knee of the temperature-resistance characteristic of the resulting PTC heater is intended to be, in all cases, at least 2500° F., preferably between 2500° F. and 3000° F., with self-limiting current flow occurring at a maximum temperature of 3000° F.

Figure 13:
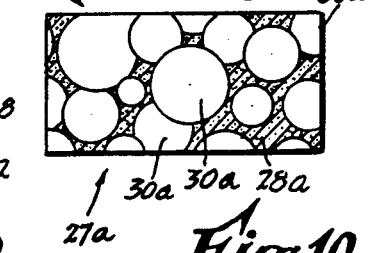
FIG. 13 is a sectional view like that of FIG. 8, but differing therefrom in that the matrix is formed with nodes and threads of electrically insulating material.

As an alternative, FIG. 13 illustrates a different embodiment involving the fabrication of a resistance heater 10*a*. In the disclosed figure, the matrix 27*a* is formed of PTC ceramic material 30*a*, and following this, an insulating vitreous substance 28*a* is introduced into the interstices of the matrix 27*a*, either by re-heating the matrix in the presence of finely divided particles of the vitreous substance, and/or the application of pressure and heat thereto. Alternately, a carrier solvent (not shown) containing the vitreous particles 28*a* in suspension could be employed, to force them into the passageways.

Figure 3:
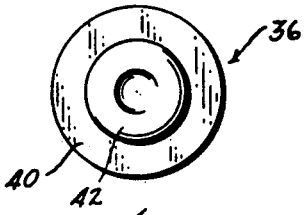
FIG. 3 is a top plan view of a wafer like heater characterized by an annular bridge of thin cross section and an outer annulus of thickened cross section, for use as an ignitor, this construction constituting another embodiment of the invention.
Figure 4:
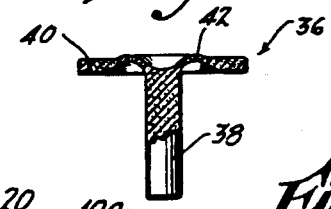
FIG. 4 is a view, partly in side elevation and partly in section, of the heater of FIG. 3.
Figure 5:
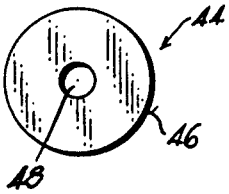
FIG. 5 is a top plan view of a cylindrical PTC heater constructed in accordance with the principles of the present invention, having a through bore of stepped dimension or diameter, constituting yet another embodiment of the invention.
Figure 6:
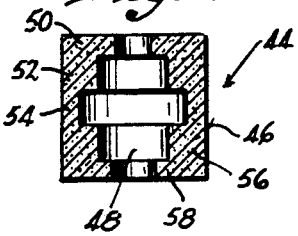
FIG. 6 is an axial section of the heater of FIG. 5.
Figure 7:
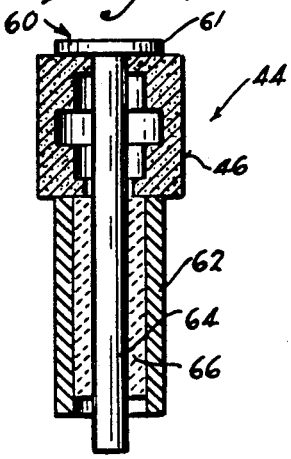
FIG. 7 is an axial section of the heater of FIGS. 5 and 6, having electrical connection means.
Figure 9:
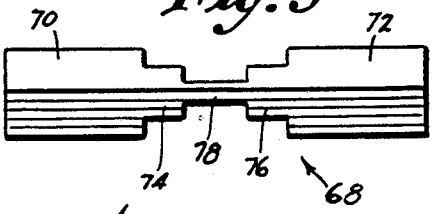
FIG. 9 is a top plan view of a modified heater, having relatively massive terminal portions connected by a smaller bridge portion, this constituting yet another embodiment of the invention.
Figure 10:
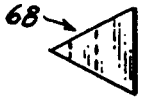
FIG. 10 is a right end elevation of the heater of FIG. 9.
Figure 11:
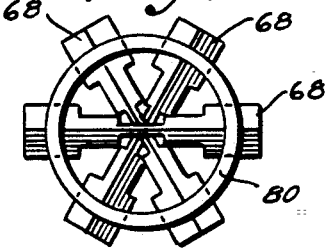
FIG. 11 is a top plan view of an air- or fluid-tunnel containing three heaters of the type illustrated in FIGS. 9 and 10.
Figure 12:
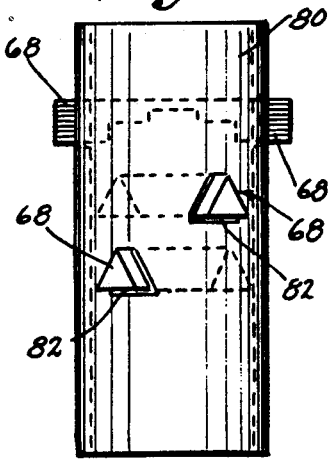
FIG. 12 is a side elevation of the heater of FIG. 11.

Several modifications of the heater construction shown in FIGS. 1, 2 and 8 are illustrated in FIGS. 3 and 4; FIGS. 5–7; FIGS. 9 and 10; FIGS. 11 and 12; and FIGS. 14 and 15.

In particular, FIGS. 3 and 4 illustrate a wafer-like heater 36 having a stem 38, and characterized by a thickened outer annular rim 40, and a relatively thinner, inner annulus 42, the latter constituting the hot spot or bridge portion of the heater. When a source of voltage is applied between the stem 38 and the outer annular rim 40, current flows through this outer annular rim 40, through the thin annular bridge portion 42 and to the stem 38. The application of either a. c. or d. c. would produce desired heating effects. The inner annular or bridge portion 42, being relatively thinner than the outer annular portion 40, heats more rapidly than the latter and the stem 38, and to a higher temperature; this permits the use of metal terminals (not shown) with the heater, without the danger of melting. The bridge portion 42 in heating more quickly, rapidly limits the maximum current flow through the outer rim 40 and stem 38, and results in a self-regulating heater that is hottest at the inner annulus 42. Such a construction would have application for ignitors of various types, such as cigar lighters. The material of the heater is similar to that diagrammatically shown in FIGS. 8 or 13.

FIGS. 5-7 illustrate another embodiment of the invention. A heater 44 has a generally cylindrical outer surface 46, with a through bore 48 characterized by stepped dimensions or diameters. There is thus formed a first annular terminal portion 50, a first annular control portion 52, an annular bridge portion 54 which exhibits maximum heating and reaches the highest temperature, another annular control portion 56, and another annular terminal portion 58 having a larger bore than the portion 50. Electrical terminals 60, 62 contact the end surfaces of the terminal portions 50, 58, as shown. The one terminal 60 comprises an end cap 61, and a stem 64 which passes through the heater 44 and is spaced from the terminal portion 58 by virtue of the larger bore of the latter. An electrically insulating bushing 66 is interposed between the stem 64 and the terminal 62.

When voltage is applied between the terminals 60, 62, the bridge portion 54, being less massive than the control portions 52, 56, or terminal portions 50, 58, heats more rapidly, quickly limiting the current flow through the entire assemblage. Again, the high temperature is restricted to the bridge portion 54, and the greater masses of the control and terminal portions limit their increase in temperature to much lower values. The advantage noted above, namely reducing the likelihood of the metal terminals 60, 62 melting, is retained without sacrifice of the high-temperature ignition point provided by the bridge portion 54.

FIGS. 9 and 10 illustrate yet another embodiment of the invention. The heater 68 has the form of a modified prism of triangular cross-sectional configuration. The heater 68 has terminal portions 70, 72, control portions 74, 76, and a bridge portion 78. FIGS. 11 and 12 show three such heaters 68 installed in a ceramic air-tunnel 80. The tunnel has pairs of diametrically opposed triangular openings of slightly greater size than that of the terminal portions 70, 72 of the respective heaters 68. Suitable ceramic cement 82 can be employed to mount the heaters 68 in the openings in the tunnel 80. The heaters are electrically insulated, since the the tunnel is of insulation and does not short circuit the terminal portions 70, 72. Electrical connections (not shown) can be made to those parts of the terminal portions 70, 72 which protrude through the openings in the tunnel 80. Air or other fluid-like substances, such as fuel vapor, passing through the tunnel 80 will be rapidly heated by the bridge portions 78 of the three heaters 68. The high temperatures achievable are sufficient to cause very rapid and positive ignition of the vapors. This construction is believed to have particular application in the case of a re-light, in flight, of a jet or rocket engine, a problem which has proved to be troublesome in the past due to unfavorable environmental conditions such as high air velocity which tends to cool off heaters, cold temperatures as experienced at high altitudes, and the presence of moisture in the form of fog, rain, or ice in the fuel stream that is being re-ignited.

Figure 14:
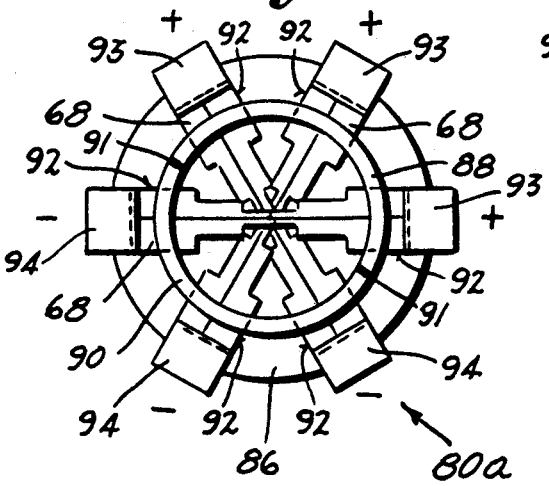
FIG. 14 is a top plan view of a modified air- or fluid-tunnel type of ignitor, illustrating connection and terminal devices.
Figure 15:
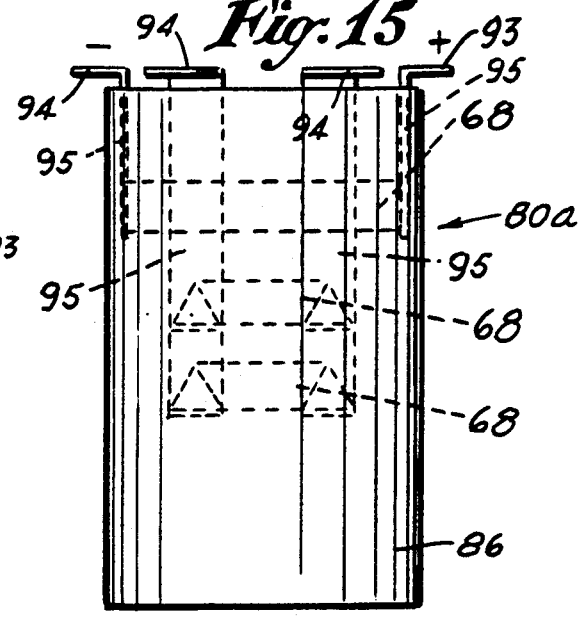
FIG. 15 is a side elevational view of the ignitor or heater of FIG. 14.

Still another embodiment of the invention is illustrated in FIGS. 14 and 15, showing a composite air-tunnel generally designated 80*a*. Three heaters are provided, which can be identical to that designated 68 in FIGS. 9 and 10. In accordance with the invention, a cylindrical ceramic housing 86 (electrically non-conductive) encircles two semi-cylindrical spaced-apart electrically conductive sleeve-like members or electrodes 88, 90 each of which has multiple openings. The respective terminal portions of the heaters 68 are electrically in contact with the walls of the openings, and preferably held in place by conductive cement.

The adjacent longitudinal edges of the electrodes 88, 90 are spaced from one another and separated by ceramic insulator strips 91, so as not to be short-circuited. The ceramic housing 86 has three pairs of internal grooves 92 provided with ledges or steps on which the heaters 68 rest. The electrodes 88, 90 are secured in the ceramic housing 86 by suitable cement. One electrode 88 can be electrically positive, while the other electrode 90 can be electrically negative. (In the case of A. C., the electrodes 88, 90 can constitute different sides of the A. C. circuit). Electrical connections can be made to the upper ends of the electrodes, and hence the terminal portions of the heaters 68, via suitable terminals. Alternatively, or in conjunction with the above, six metal leaf springs 95 can occupy the six grooves 92 respectively and press against the terminal end portions of the heaters 68 to effect electrical connection thereto. The leaf springs can have paired terminal portions 93 and 94, as shown. This construction has the advantage that the electrodes 88, 90 being long and of relatively high mass with respect to that of the heaters, can effectively dissipate much of the heat conducted thereto by virtue of their surface contact with the terminal portions of the heaters, virtually eliminating problems with melting of the metal of which the electrodes is constituted.

The examples shown are intended to be illustrative only, and it is believed that many other applications of the principles set forth above can be developed in the electric heater art.

As presently understood, the areas of the heaters that have been referred to as "control portions" have the effect of dissipating heat generated in the "bridge portions"; making the control portions more massive would reduce the steady state temperature of the bridge portions somewhat, as well as slowing the heating effect somewhat, whereas making the control portions less massive would have the opposite effects.

The invention as set forth above therefore provides an improved method of making high temperature PTC electrical heaters of the kind described above. Referring to FIGS. 8 and 13, for example, this method comprises forming a sintered porous matrix of one ceramic material, and thereafter impregnating the matrix with another ceramic material, one material being electrically insulating and other material being electrically conducting, but resistive.

Referring to FIG. 8, the insulating material comprises the granules or "balls" 28 which are compressed in a mold (not shown) and then fired or sintered to form a matrix. The matrix is then forcefully impregnated with the electrically conducting PTC material 30 consisting of particles, to form the nodes 32 and threads 34 which form the electrically conducting PTC grid of the heater 10.

In the case of FIG. 13, the PTC conducting or resistive material comprises the ceramic granules or "balls" 30*a* which are compressed in a mold (not shown) and then fired or sintered to form a matrix having conducting nodes and threads at and adjacent the points of contact of the particles. This matrix is then forcefully impregnated with the electrically insulating ceramic material 28*a*.

The importance of the triangular cross section is that there occurs a desired reduction in the air speed at the undersurfaces of the heaters when they are employed, for example, in the tunnel of FIGS. 11 and 12, or that of FIGS. 14 and 15; such reduction in speed promotes heat transfer to the air flowing past the heater. Specifically, air flowing downwardly through the tunnel would experience turbulence after it arrived at the lower face of a heater. This turbulent or vortex-type flow in this area would both enable and promote transfer of heat from the heater itself to the air, and would thus contribute to the desired result, namely efficient transfer of heat to the air flowing past the heater.

From the above it can be seen that I have provided novel and improved heater constructions that are are rugged and reliable in use, and lend themselves to connection to suitable sources of electricity without the need for sophisticated clips or terminals that would otherwise have to withstand extremely high temperatures. The illustrated structures provide for rapid heating of a fluid or solid to extremely high temperatures, approaching 3000° F. Where the PTC material employed is molybdenum disilicide, the knee of the temperature/resistance curve is in this temperature range. Stated differently, the increase in resistance occurs very rapidly as 3000° F. is approached. This fact makes the heaters well adapted for use as ignitors, whether for fuel in an aircraft, fuel in a diesel engine (glow plug), or as ignitors for electric cigar lighters.

The disclosed devices are thus seen to represent distinct advances and improvements in the field of electric heaters.

Variations and modifications are possible without departing from the spirit of the invention.

Each and every one of the appended claims defines an aspect of the invention which is separate and distinct from all others, and accordingly it is intended that each claim be treated as such when examined in the light of the prior art devices in any determination of novelty or validity.

What is claimed is:

1. A high-speed high temperature electrical heater construction, comprising in combination:

a) means constituting an elongate multi-piece hollow pipe having spaced-apart inlet and outlet openings and having a longitudinal axis, the pieces of said pipe extending axially, said hollow pipe having an unobstructed bore defining an elongate air-tunnel, b) a plurality of elongate PTC resistance members mounted in the air-tunnel of the pipe in axially spaced-apart relation and extending transversely thereof, said PTC resistance members each having intermediate ignitor portions extending diametrically across the unobstructed bore of the hollow pipe and having opposite integral electrical terminal end portions extending through the walls of said pipe, said end portions being adapted for connection to an electrical supply, c) each of said PTC resistance members being disposed between said inlet and said outlet openings of the pipe, d) the pieces of said hollow pipe comprising two sleeve-like mutually electrically insulated current supply conductors for said PTC resistance members, said conductors having sets of openings which are axially displaced from each other and which receive said opposite end portions of the PTC resistance members, and e) means for electrically connecting said opposite end portions of the PTC members to said sleeve-like conductors respectively to be energized thereby.

2. A high temperature heater construction as set forth in claim 1, and further including:

a) an outer pipe-like housing surrounding said hollow pipe in telescopic relation thereto, b) said outer housing having a multiplicity of longitudinally-extending grooves with end ledges on which said terminal portion of the PTC resistance members rest.

3. A high-speed high temperature electrical heater construction as set forth in claim 1, wherein:

a) said PTC resistance members comprise axially spaced-apart bars disposed in axial planes that make angles with each other.

4. A high temperature heater construction as set forth in claim 3, wherein:

a) said PTC resistance members have elongate shapes with intermediate neck portions of reduced cross section as compared to that of said terminal portions.

5. A high temperature heater construction as set forth in claim 4, wherein:

a) said neck portions have a substantially triangular cross-sectional configuration.

6. A high temperature heater construction as set forth in claim 3, wherein:

a) said terminal portions are thickened and said members have relatively thinner center portions, constituting bridges of reduced mass, capable of generating heat at a rate faster than that of the thickened terminal portions.

7. A high temperature heater construction as set forth in claim 3, wherein:

a) said PTC resistance members have control portions connected to said terminal portions respectively, and have high-temperature bridge portions connected to said control portions to pass current therebetween, said terminal portions, control portions, and bridge portions effecting series electrical circuits, the cross section of said bridge portions being a small fraction of the cross sections of the control portions, and the cross sections of the control portions being respectively less than the cross sections of the terminal portions.

8. A high temperature heater construction as set forth in claim 7, wherein:

a) at least one of said cross sections is substantially triangular.

9. A high temperature heater construction as set forth in claim 3, wherein:

a) said PTC resistance members have portions of substantially triangular cross sectional configuration, which triangular cross sectional configuration contributes to the turbulent flow of air flowing past the member and thus increases heat transfer from said PTC resistance members to said air.

10. A high speed temperature electrical heater construction as set forth in claim 3, wherein:

a) said multi-piece pipe comprises two semi-cylindrical parts which are mated with each other to form longitudinal seams in the pipe.

11. A high-speed high temperature electrical heater construction as set forth in claim 10, wherein:

a) said semi-cylindrical parts are separated by insulation and can be energized with different electrical polarization.

12. A high-speed high temperature electrical heater construction as set forth in claim 3, wherein;

a) said PTC resistance members substantially pass through the axis of the hollow pipe at longitudinally different locations on said axis.

* * * * *